US007281825B2

(12) United States Patent
Neckels

(10) Patent No.: US 7,281,825 B2
(45) Date of Patent: Oct. 16, 2007

(54) RETRACTABLE DIMMER SLEEVE FOR AN ELONGATED LIGHT SOURCE

(76) Inventor: Nathan A. Neckels, c/o A.W. Bennett Enterprises Inc P.O. Box 2729, Eugene, OR (US) 97402

( * ) Notice: Subject to any disclaimer, the term of this patent is extended or adjusted under 35 U.S.C. 154(b) by 214 days.

(21) Appl. No.: 11/177,881

(22) Filed: Jul. 8, 2005

(65) Prior Publication Data

US 2007/0201224 A1 Aug. 30, 2007

(51) Int. Cl.

| | |
|---|---|
| ***F21V 11/00*** | (2006.01) |
| ***F21V 1/00*** | (2006.01) |
| ***F21V 1/16*** | (2006.01) |
| ***F21V 14/08*** | (2006.01) |

(52) U.S. Cl. ..... 362/351; 362/260; 362/278; 362/320; 362/352; 362/357

(58) Field of Classification Search ..... 362/352, 362/320, 278, 360, 260, 154, 266, 270, 257, 362/351, 311, 317, 355–357, 290; 160/67
See application file for complete search history.

(56) References Cited

U.S. PATENT DOCUMENTS

| | | | | |
|---|---|---|---|---|
| 3,805,053 | A | 4/1974 | Julinot | |
| 4,186,431 | A | 1/1980 | Engel et al. | |
| 4,642,741 | A | 2/1987 | Cohn | |
| 4,739,454 | A * | 4/1988 | Federgreen | 362/133 |
| 4,991,070 | A | 2/1991 | Stob | |
| 5,001,455 | A * | 3/1991 | Starchevich | 340/332 |
| 5,510,965 | A | 4/1996 | Teakell | |
| 5,811,937 | A * | 9/1998 | Jiang | 315/56 |
| 6,231,212 | B1 * | 5/2001 | Cooney et al. | 362/290 |
| 6,511,204 | B2 | 1/2003 | Emmel et al. | |
| 6,866,403 | B1 * | 3/2005 | Schaak | 362/284 |
| 2005/0047138 | A1 | 3/2005 | Rochna | |
| 2005/0146882 | A1 * | 7/2005 | Liao et al. | 362/352 |

FOREIGN PATENT DOCUMENTS

| | | |
|---|---|---|
| FR | 2701755 | 8/1994 |

* cited by examiner

*Primary Examiner*—Jong-Suk (James) Lee
*Assistant Examiner*—David R Crowe
(74) *Attorney, Agent, or Firm*—David S. Alavi

(57) ABSTRACT

A retractable dimmer sleeve comprises sleeve material formed into an elongated enclosed passage having an open end and an interior volume for receiving an elongated light source. The dimmer sleeve enables, during operation of a light source while received within the sleeve, adjustment of a length of a selected portion of the light source that is occluded by the dimmer sleeve so that only a fraction of light emitted by the light source escapes the dimmer sleeve. The apparatus may further comprise an elongated light source at least partially enclosed by the dimmer sleeve. A method comprises: enclosing at least a portion of the light source with the retractable dimmer sleeve; and moving, during operation of the light source while received within the sleeve, an end of the dimmer sleeve along the light source, thereby adjusting a length of the light source that is occluded by the dimmer sleeve.

19 Claims, 1 Drawing Sheet

RETRACTABLE DIMMER SLEEVE FOR AN ELONGATED LIGHT SOURCE

BACKGROUND

The field of the present invention relates to elongated light sources. In particular, a retractable dimmer sleeve is described herein for an elongated light source.

A wide variety of attachments or accessories are available for altering the output of an elongated light source, such as a fluorescent tube. Some of these are described in:

U.S. Pat. Pub. No. 2005/0047138 entitled "Fluorescent light diffuser" by Rochna;

U.S. Pat. No. 6,231,212, entitled "Fluorescent light baffle" by Cooney et al;

U.S. Pat. No. 5,510,965 entitled "Adjustable reflector/director for fluorescent light fixture" by Teakell;

U.S. Pat. No. 6,511,204 entitled "Light tube" by Emmel et al;

U.S. Pat. No. 4,991,070 entitled "Sleeve for a light element" by Stob;

U.S. Pat. No. 4,642,741 entitled "Fluorescent lighting system" by Cohn;

U.S. Pat. No. 4,186,431 entitled "Linear light source" by Engel et al;

U.S. Pat. No. 3,805,053 entitled "Fluorescent fixture" by Julinot; and

Fr. Pat. No. FR2701755 entitled "Fluorescent tube lamp of the flexible luminous panel type" by Morisot et al.

SUMMARY

An apparatus comprises a retractable dimmer sleeve. The retractable dimmer sleeve comprises sleeve material formed into an elongated substantially enclosed passage having at least one open end and an interior volume for receiving at least a portion of an elongated light source. The dimmer sleeve is adapted for enabling, during operation of an elongated light source while at least partly received within the dimmer sleeve, adjustment of a length of a selected portion of a light-emitting segment of the elongated light source that is occluded by the dimmer sleeve so that only a desired fraction of light emitted by the elongated light source escapes the dimmer sleeve for illuminating a space near the elongated light source. The apparatus may further comprise an elongated light source at least partially enclosed by the dimmer sleeve. A method comprises: enclosing at least a portion of an elongated light source with a retractable dimmer sleeve; and moving, during operation of the elongated light source while at least partly received within the dimmer sleeve, at least one end of the dimmer sleeve along the elongated light source to a selected position, thereby adjusting a length of a selected portion of a light-emitting segment of the elongated light source that is occluded by the dimmer sleeve so that only a desired fraction of light emitted by the elongated light source escapes the dimmer sleeve for illuminating a space near the elongated light source.

Objects and advantages pertaining to a dimmer sleeve for an elongated light source may become apparent upon referring to the exemplary embodiments illustrated in the drawings and disclosed in the following written description and/or claims.

The embodiment shown in the Figures is exemplary, and should not be construed as limiting the scope of the present disclosure and/or appended claims. Other specific embodiments not illustrated in the Figures are described in the following written description and shall fall within the scope thereof or within the scope of the appended claims.

DETAILED DESCRIPTION OF EMBODIMENTS

Figure 1:
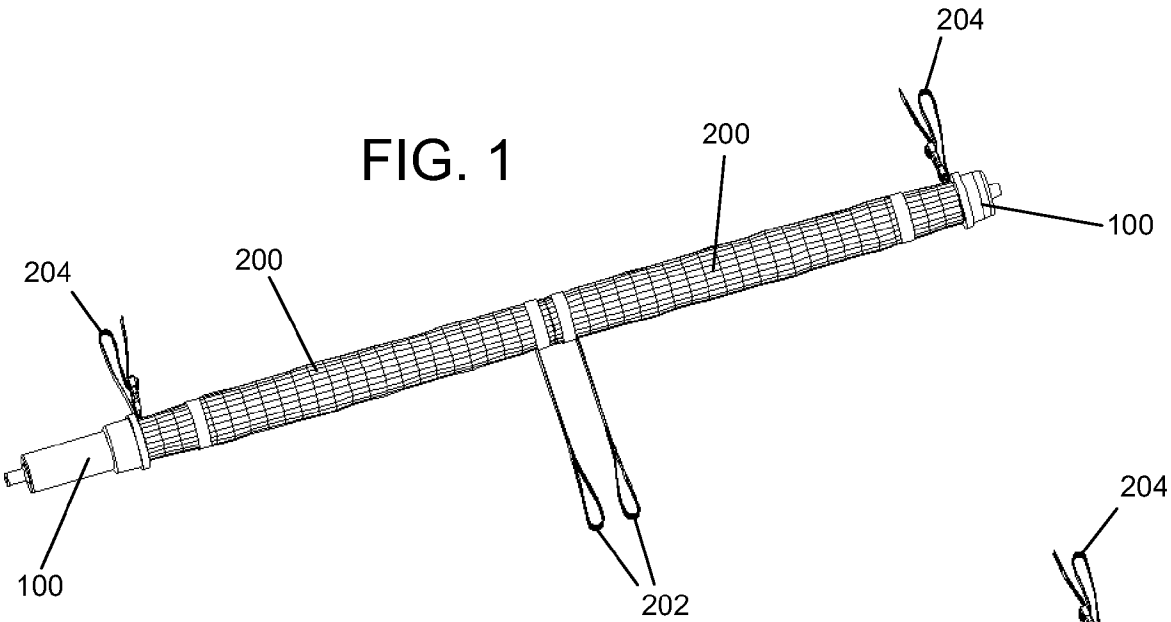
FIG. 1 illustrates schematically an exemplary embodiment of a retractable dimmer sleeve on an elongated light source arranged to substantially completely occlude the light source.
Figure 2:
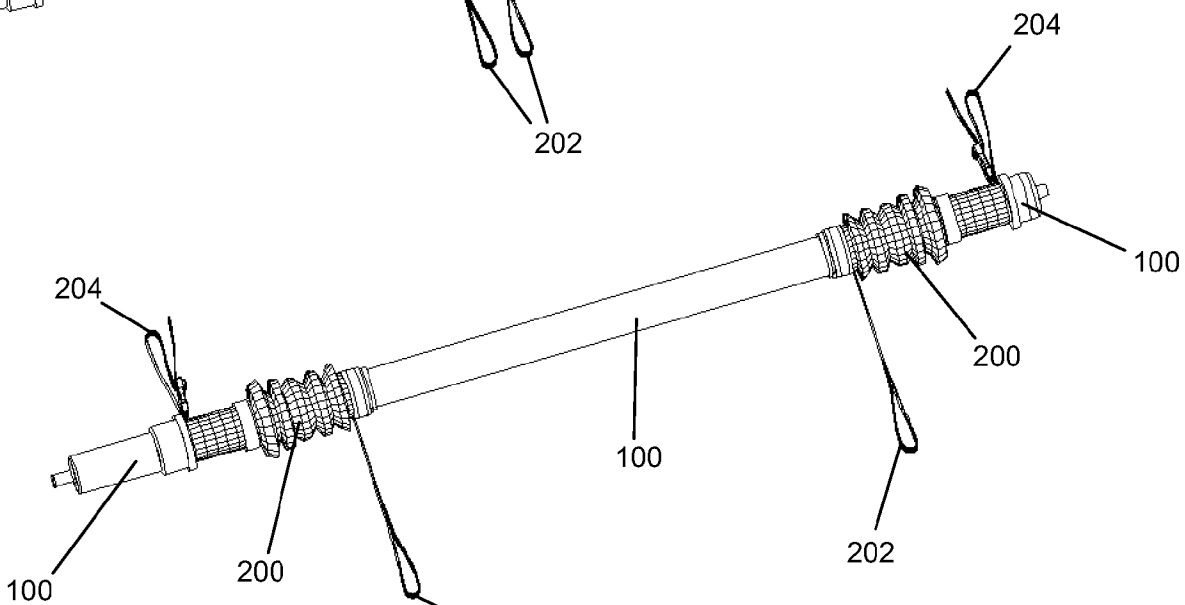
FIG. 2 illustrates schematically an exemplary embodiment of a retractable dimmer sleeve on an elongated light source arranged to expose a portion of the light source.

An exemplary apparatus illustrated schematically in FIGS. 1 and 2 comprises a retractable dimmer sleeve 200. The retractable dimmer sleeve 200 comprises sleeve material formed into an elongated substantially enclosed passage having at least one open end and an interior volume for receiving at least a portion of an elongated light source 100. The dimmer sleeve 200 is adapted for enabling, during operation of an elongated light source while at least partly received within the dimmer sleeve, adjustment of a length of a selected portion of a light-emitting segment of the elongated light source 100 that is occluded by the dimmer sleeve 200, so that only a desired fraction of light emitted by the elongated light source 100 escapes the dimmer sleeve 200 for illuminating a space near the elongated light source 100.

The apparatus may further comprise the elongated light source 100, which may be at least partially enclosed by the dimmer sleeve 200. The elongated light source 100 may comprise a fluorescent tube, or any other type of elongated light source. Such sources may include, but are not limited to, incandescent sources, fluorescent sources, phosphorescent sources, semiconductor sources, and so forth, all of which shall fall within the scope of the present disclosure or appended claims. The elongated light source 100 may further comprise a protective housing (at least partly transparent or translucent) that substantially encloses the fluorescent tube, with the protective housing at least partly enclosed by the dimmer sleeve 200. Both types of elongated sources (with or without a protective housing) shall fall within the scope of the present disclosure or appended claims.

The dimmer sleeve 200 may be configured so as to enable enclosure of the entire light source 100, including the light-emitting segment of the light source as well as any associated structures such as electrical connections, sockets, electronics housings, switches, ballast housings, and so on. Alternatively, dimmer sleeve 200 may be configured so as to enable enclosure of only the light-emitting segment of the light source 100, while leaving other portions exposed, such as the afore-mentioned electrical connections, sockets, electronics housings, switches, ballast housings, and so on. The dimmer sleeve 200 may be open at only one end and may substantially enclose the other end of the light source 100, or the dimmer sleeve 200 may be open at both ends, thereby providing access to both end of the light source 100.

The sleeve material forming dimmer sleeve 100 may be substantially opaque, and the dimmer sleeve 200 may be adapted for enabling the entire light-emitting segment of the elongated light source 100 to be substantially enclosed by the dimmer sleeve 200, thereby enabling substantially complete containment within the dimmer sleeve 200 of the light emitted by the elongated light source 100. When adapted in this way, the dimmer sleeve 200 may be used to essentially "turn off" light source 100 (i.e., substantially prevent illumination of an area around light source 100 by light from source 100) without interrupting the operation of the light source 100. By moving an end of a substantially opaque dimmer sleeve 200 along the elongated light source 100, the light output of source 100 may be continuously adjusted between a maximum light output (when a maximum length of the light-emitting segment of the light source 100 is exposed) to a minimum light output wherein virtually no light escapes form the dimmer sleeve 200 (when the entire light-emitting segment of the elongated source 100 is substantially enclosed by the substantially opaque dimmer sleeve 200). Use of dimmer sleeve 200 enables continuous adjustment of an illumination level provided by a light source even if the output of the source cannot be readily adjusted (as is the case with fluorescent tubes, for example; typically, such tubes are either fully on or off, with no intermediate operating level).

If the sleeve material forming dimmer sleeve 200 is not opaque, but transmits a fraction of the light incident thereon, then the dimmer sleeve may be used to vary the light output of the elongated light source 100 between a maximum output (when a maximum length of the light-emitting segment of the light source 100 is exposed) to a non-zero minimum light output (when the entire light-emitting segment of the elongated source 100 is substantially enclosed by the dimmer sleeve 200). The minimum light output is determined by the transmission characteristics of the non-opaque dimmer sleeve material.

In an exemplary embodiment, the sleeve material may comprise flexible fabric (i.e. cloth). In such an embodiment, sliding the open end of the dimmer sleeve 200 in a first direction along the elongated light source 100 and at least partly bunching the flexible fabric decreases the length of a selected portion of a light-emitting segment of the elongated light source 100 that is occluded by the dimmer sleeve (as in FIG. 2). As a result, an increased fraction of light emitted by the elongated light source 100 escapes the dimmer sleeve 200 to illuminate the space near the elongated light source 200. Sliding the open end of the dimmer sleeve 200 in a second direction along the elongated light source 100 opposite the first direction and at least partly unbunching the flexible fabric increases the length of a selected portion of a light-emitting segment of the elongated light source that is occluded by the dimmer sleeve (as in FIG. 1). As a result, a decreased fraction of light emitted by the elongated light source 100 escapes the dimmer sleeve 200 to illuminate the space near the elongated light source.

The flexible fabric may be substantially opaque, and the dimmer sleeve 200 may be sufficiently long so as to substantially enclose the entire light-emitting segment of the elongated light source when unbunched. As described hereinabove, this enables substantially complete containment within the dimmer sleeve 200 of the light emitted by the elongated light source 100. Alternatively, the flexible fabric may partially transmit light, with the resulting partially-transmitting dimmer sleeve 200 operating as described hereinabove.

Other configurations or materials may be employed for forming the dimmer sleeve 200 while remaining within the scope of the present disclosure or appended claims. For example, any suitable configuration or mechanism may be employed for adjusting the length of the elongated light source occluded by the dimmer sleeve, including but not limited to one or more of: a flexible sleeve (as the fabric sleeve described hereinabove); a folding sleeve; a collapsible sleeve; an accordion-like sleeve; a telescoping sleeve; and so on. Various materials may be employed for the dimmer sleeve within the constraints imposed by the dimmer sleeve configuration or mechanism, by the degree of opacity required, by the use environment, by the temperature of the light source during operation, by the presence or absence of a protective housing, by space available for the elongated light source or a fixture therefor, or by other factors. Suitable materials may include but are not limited to one or more of: cloth or fabric; paper; cardboard; plastic or other polymer; metal or alloy; wood; or other materials. Any of these materials may or may not be coated or otherwise treated in any suitable way (e.g. a coating may be applied for making a cloth dimmer sleeve opaque, heat resistant, etc). The materials may be flexible, suitable for forming a dimming sleeve that may be bunched, gathered, folded, accordion-like, or collapsed, and so forth, or may be somewhat rigid, suitable for forming a dimming sleeve that may be folded, telescoped, accordion-like, collapsible, and so forth. Any such suitable configurations and materials shall fall within the scope of the present disclosure or the appended claims.

In the exemplary embodiment of FIGS. 1 and 2, the dimmer sleeve 200 comprises two dimmer sleeve segments, and each dimmer sleeve segment has at least one open end movable along the elongated light source 100. The dimmer sleeve 200 may comprise a single segment, two segments (as in FIGS. 1 and 2), or more segments. Each segment of the dimmer sleeve 200 (whether one, two, or more segments) may be freely movable along the length of the elongated light source. Alternatively, one or more segments may be secured at some point along its length to the elongated light source, typically at one end of the sleeve segment. In this way the length of the occluded portion of the light source 100 may be readily adjusted by moving only the movable end of the sleeve segment, while the other end remains fixed to the light source. With such an arrangement, adjustment of the dimmer sleeve may be accomplished with one hand, where otherwise two hands might be required (one hand to hold a portion of the dimmer sleeve segment in place while the other hand moves an end of the sleeve segment, for example). The sleeve segment may be secured to the light source in any suitable way, including but not limited to one or more of: fasteners, adhesive, ties, straps, loops, drawstrings, elastics, friction, hook-and-loop (Velcro®), flanges, tabs, slots, and so on. Any of these may be provided on the sleeve, on the light source, or on both. For a flexible fabric (i.e. cloth) dimmer sleeve, fabric straps or loops or ties may be particularly suitable. The movable end of a sleeve segment may be adapted for remaining in place once it is moved to a desired location. This may be achieved in any suitable way, including those recited hereinabove for securing the sleeve to the light source. For a fabric sleeve, one suitable adaptation may comprise a sleeve circumference at the movable end made large enough to be movable by sufficient force applied by a user, yet small enough to remain in place by friction when no force is applied by a user.

To facilitate movement of the movable end of the dimmer sleeve 200, the sleeve may further comprise a handle 202 for moving the open end of the dimmer sleeve along the elongated light source 100. The handle 202 is typically secured to the dimmer sleeve at the open end thereof. The handle may be configured in any suitable fashion from any suitable material(s). In use situations wherein the light source 100 is positioned overhead for illuminating an area, it may be desirable to provide a handle 202 that extends downward so as to be within reach of a user. For a fabric dimmer sleeve 200, a handle 202 comprising a fabric strap or loop may be particularly suitable, which hangs down from the end of the dimmer sleeve 202. The length of the handle may be made adjustable, if desired The dimmer sleeve 200 may further comprise at least one hanger 204 for suspending the dimmer sleeve and an elongated light source 100 enclosed therein. The hanger 204 may be configured in any suitable fashion from any suitable material(s), and may be positioned anywhere on the dimmer sleeve 200 that results in adequate, stable support for the light source 100 and does not substantially interfere with the movement of the movable end of dimmer sleeve 200. For a fabric dimmer sleeve 200, a hanger 204 comprising a fabric strap or loop may be particularly suitable, with the hanger secured to or suspended by a hook, bracket, or other suitable hardware or structure found in the use environment. The length of the hanger may be made adjustable, if desired.

A method for using the dimmer sleeve 200 comprises: enclosing at least a portion of the elongated light source 100 with the retractable dimmer sleeve 200; and moving, during operation of the light source 100 while at least partly received within the dimmer sleeve 200, at least one end of the dimmer sleeve 100 along the light source to a selected position, thereby adjusting a length of a selected portion of a light-emitting segment of the elongated light source that is occluded by the dimmer sleeve so that only a desired fraction of light emitted by the elongated light source escapes the dimmer sleeve for illuminating a space near the elongated light source.

A retractable dimmer sleeve 200 for an elongated light source 100 may be used in any use environment or use situation in which controlled dimming of the light source is needed or desired. In one use example, a dimmer sleeve 200 constructed from fabric or cloth may be used in conjunction with a portable fluorescent tube light source in a tent or other temporary shelter (also typically constructed from fabric). The dimmer sleeve 200 and the shelter may be constructed from common materials, or from differing materials. Both the shelter and dimmer sleeve 200 may be stored compactly due to their fabric construction. Hangar straps 204 provided on the dimmer sleeve 200 may readily enable suspension of the light source within the shelter, either from frame elements thereof or from attachments provided on the fabric portions of the shelter.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: i) it is explicitly stated otherwise, e.g., by use of "either . . . or", "only one of . . . ", or similar language; or ii) two or more of the listed alternatives are mutually exclusive within the particular context, in which case "or" would encompass only those combinations involving non-mutually-exclusive alternatives. It is intended that equivalents of the disclosed exemplary embodiments and methods shall fall within the scope of the present disclosure and/or appended claims. It is intended that the disclosed exemplary embodiments and methods, and equivalents thereof, may be modified while remaining within the scope of the present disclosure or appended claims.

What is claimed is:

1. An apparatus comprising a retractable dimmer sleeve, wherein:

the retractable dimmer sleeve comprises flexible fabric sleeve material formed into an elongated enclosed passage having at least one open end and an interior volume for receiving at least a portion of an elongated light source;

the dimmer sleeve is arranged to enable, during oreration of the elongated light source while at least partly received within the dimmer sleeve, adjustment of a length of a selected portion of a light-emitting segment of the elongated light source that is occluded by the dimmer sleeve so that only a desired fraction of light emitted by the elongated light source escapes the dimmer sleeve for illuminating a space near the elongated light source;

the dimmer sleeve is arranged so that sliding the open end of the dimmer sleeve in a first direction along the elongated light source and at least partly bunching the flexible fabric decreases the length of a selected portion of a light-emitting segment of the elongated light source that is occluded by the dimmer sleeve, thereby increasing the fraction of light emitted by the elongated light source that escapes the dimmer sleeve and illuminates the space near the elongated light source; and the dimmer sleeve is arranged so that sliding the open end of the dimmer sleeve in a second direction along the elongated light source opposite the first direction and at least partly unbunching the flexible fabric increases the length of a selected portion of a light-emitting segment of the elongated light source that is occluded by the dimmer sleeve, thereby decreasing the fraction of light emitted by the elongated light source that escapes the dimmer sleeve and illuminates the space near the elongated light source.

2. The apparatus of claim 1, further comprising an elongated light source at least partially enclosed by the dimmer sleeve.

3. The apparatus of claim 2, wherein the elongated light source comprises a fluorescent tube.

4. The apparatus of claim 3, wherein the elongated light source further comprises a protective housing substantially enclosing the fluorescent tube, and the protective housing is at least partly enclosed by the dimmer sleeve.

5. The apparatus of claim 1, wherein:

the sleeve material is substantially opaque; and the dimmer sleeve is adapted for enabling the entire light-emitting segment of the elongated light source to be substantially enclosed by the dimmer sleeve, thereby enabling substantially complete containment within the dimmer sleeve of the light emitted by the elongated light source.

6. The apparatus of claim 1, wherein: the flexible fabric is substantially opaque, and the dimmer sleeve is sufficiently long so as to substantially enclose the entire light-emitting segment of the elongated light source by moving the open end of the dimmer sleeve in the second direction and at least partly unbunching the flexible fabric, thereby enabling substantially complete containment within the dimmer sleeve of the light emitted by the elongated light source.

7. The apparatus of claim 1, further comprising a handle for moving the open end of the dimmer sleeve along the elongated light source, the handle being secured to the dimmer sleeve at the open end thereof.

8. The apparatus of claim 1, wherein the dimmer sleeve is secured to the elongated light source at a point along the length thereof.

9. The apparatus of claim 1, wherein the dimmer sleeve comprises at least two dimmer sleeve segments, and each dimmer sleeve segment has at least one open end movable along the elongated light source.

10. The apparatus of claim 1, wherein the dimmer sleeve further comprises at least one hanger for suspending the dimmer sleeve and an elongated light source.

11. A method, comprising:

enclosing at least a portion of an elongated light source with a retractable dimmer sleeve; and moving, during operation of the elongated light source while at least partly received within the dimmer sleeve, at least one end of the dimmer sleeve along the elongated light source to a selected position, thereby adiusting a length of a selected portion of a light-emitting segment of the elongated light source that is occluded by the dimmer sleeve so that only a desired fraction of light emitted by the elongated light source escapes the dimmer sleeve for illuminating a space near the elongated light source, wherein:

the retractable dimmer sleeve comprises flexible fabric sleeve material formed into an elongated enclosed passage having at least one open end and an interior volume for receiving at least a portion of the elongated light source;

the dimmer sleeve is arranged to enable adjustment of a length of a selected portion of a light-emitting segment of the elongated light source that is occluded by the dimmer sleeve so that only a desired fraction of light emitted by the elongated light source escapes the dimmer sleeve for illuminating a srace near the elongated light source;

the dimmer sleeve is arranged so that sliding the open end of the dimmer sleeve in a first direction along the elongated light source and at least partly bunching the flexible fabric decreases the length of a selected portion of a light-emitting segment of the elongated light source that is occluded by the dimmer sleeve, thereby increasing the fraction of light emitted by the elongated light source that escapes the dimmer sleeve and illuminates the space near the elongated light source; and the dimmer sleeve is arranged so that sliding the open end of the dimmer sleeve in a second direction along the elongated light source opposite the first direction and at least partly unbunching the flexible fabric increases the length of a selected portion of a light-emitting segment of the elongated light source that is occluded by the dimmer sleeve, thereby decreasing the fraction of light emitted by the elongated light source that escapes the dimmer sleeve and illuminates the space near the elongated light source.

12. The method of claim 11, wherein the elongated light source comprises a fluorescent tube.

13. The method of claim 12, wherein the elongated light source further comprises a protective housing substantially enclosing the fluorescent tube, and the protective housing is at least partly enclosed by the dimmer sleeve.

14. The method of claim 11, the sleeve material is substantially opaque; and the dimmer sleeve is adapted for enabling the entire light-emitting segment of the elongated light source to be substantially enclosed by the dimmer sleeve, thereby enabling substantially complete containment within the dimmer sleeve of the light emitted by the elongated light source.

15. The method of claim 11, wherein: the flexible fabric is substantially opaque, and the dimmer sleeve is sufficiently long so as to substantially enclose the entire light-emitting segment of the elongated light source by moving the open end of the dimmer sleeve in the second direction and at least partly unbunching the flexible fabric, thereby enabling substantially complete containment within the dimmer sleeve of the light emitted by the elongated light source.

16. The method of claim 11, further comprising a handle for moving the open end of the dimmer sleeve along the elongated light source, the handle being secured to the dimmer sleeve at the open end thereof.

17. The method of claim 11, wherein the dimmer sleeve is secured to the elongated light source at a point along the length thereof.

18. The method of claim 11, wherein the dimmer sleeve comprises at least two dimmer sleeve segments, and each dimmer sleeve segment has at least one open end movable along the elongated light source.

19. The method of claim 11, wherein the dimmer sleeve further comprises at least one hanger for suspending the dimmer sleeve and an elongated light source.

* * * * *

UNITED STATES PATENT AND TRADEMARK OFFICE

CERTIFICATE OF CORRECTION

PATENT NO. : 7,281,825 B2
APPLICATION NO. : 11/177881
DATED : October 16, 2007
INVENTOR(S) : Neckels It is certified that error appears in the above-identified patent and that said Letters Patent is hereby corrected as shown below:

Column 7, line 28, the word "srace," should read --space--

Signed and Sealed this

Twenty-ninth Day of July, 2008

JON W. DUDAS
*Director of the United States Patent and Trademark Office*